US006758468B2

(12) United States Patent
DaCunha et al.

(10) Patent No.: US 6,758,468 B2
(45) Date of Patent: Jul. 6, 2004

(54) METHOD OF IMPROVING RETARD MECHANISM IN FRICTION FEEDERS

(75) Inventors: Steven J. DaCunha, West Hartford, CT (US); Gregory P. Skinger, Southbury, CT (US); Arthur H. DePol, Brookfield, CT (US); Thomas P. Nash, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/280,169

(22) Filed: Oct. 25, 2002

(65) Prior Publication Data

US 2004/0080093 A1 Apr. 29, 2004

(51) Int. Cl.[7] ..... B65H 3/06

(52) U.S. Cl. ..... 271/35; 271/121; 271/124; 271/137

(58) Field of Search ..... 271/35, 121, 124, 271/125, 137

(56) References Cited

U.S. PATENT DOCUMENTS 2,273,280 A * 2/1942 Mayer ..... 271/35
2,339,835 A * 1/1944 Bruckhardt ..... 271/35
4,666,140 A * 5/1987 Godlewski ..... 271/35
5,016,866 A * 5/1991 Takahashi ..... 271/122
5,244,198 A * 9/1993 Green ..... 271/125
5,294,102 A * 3/1994 Ifkovits et al. ..... 271/35
6,402,135 B1 * 6/2002 Werner ..... 271/35
6,485,012 B1 * 11/2002 Bakoledis ..... 271/35
6,585,252 B1 * 7/2003 Russo et al. ..... 271/122

* cited by examiner

*Primary Examiner*—David H Bollinger
(74) *Attorney, Agent, or Firm*—Michael J. Cummings; Charles R. Malandra, Jr.; Angelo N. Chaclas

(57) ABSTRACT

A sheet feeder having a driving mechanism to release sheets of document from a stack out of an exit nip, one sheet at a time. A retard mechanism is used to prevent other sheets from being drawn out of the exit nip by the frictional force between the sheets. The retard mechanism has a frictional surface driven by a cylinder, which is allowed to rotate freely in only one direction to move the frictional surface against the editing direction of the released sheet. The driving mechanism is programmed to move backward in an intermittent manner to move the sheets in the bottom of the stack away from the exit nip so as to cause the cylinder to rotate in order to spread out the wear of the frictional surface. Preferably, the frictional surface has a plurality of cuts in a helical or partially helical pattern.

20 Claims, 7 Drawing Sheets

METHOD OF IMPROVING RETARD MECHANISM IN FRICTION FEEDERS

TECHNICAL FIELD

The present invention relates generally to a feeder for feeding mail related items such as mail insert materials, envelopes or mailpieces and, more specifically, to a retarding element in a friction feeder for preventing multiple feeds.

BACKGROUND OF THE INVENTION

Friction feeders are known in the art. As the name suggests, a friction feeder relies on the interaction of several components around the exit nip of the feeder that results in the singulation of paper documents in a paper stack. The common components in most friction feeders are the driving mechanism to drive a sheet of paper document out of the exit nip and the retarding element to retain all the other sheets in the stack so as to prevent multiple feeds. To provide the necessary friction for retaining the other sheets in the stack, the surface of the retarding element is usually made of an elastomeric material or a hard, rough coating. Ifkovits, Jr. et al. (U.S. Pat. No. 5,294,102, hereafter referred to as Ifkovits) discloses a friction feeder wherein the surface of the retarding element is coated with tungsten carbide grit. Godlewski (U.S. Pat. No. 4,666,140) discloses a friction feeder wherein the surface of the retarding element is made of an elastomeric-like material. Green (U.S. Pat. No. 5,244,198) discloses a friction feeder wherein the retarding element is a continuous belt made of an elastomeric material mounted on a pair of rollers. A friction feeder can be designed to operate as a top feeder or a bottom feeder. The above-mentioned friction feeders are bottom feeders, wherein the sheets in a generally vertical stack are moved out the stack, one at a time, by a driving mechanism below the stack. A typical friction feeder is shown in FIG. 1. As shown, the feeder 1 uses a driving mechanism 30 to drive the bottom sheet 10 of a stack 20 out of the exit nip 64 and a retarding element 40 (a cylindrical member) to hold back the other bottom sheets. In general, the retarding element 40 has a relatively large diameter at the exit nip so that a number of sheets at the bottom of the stack can fan out to follow the surface curvature of the retarding element, forming a singulated stack portion 24. In the singulated portion, the sheets are slightly separated from each other in that the leading edge of one sheet is positioned slightly ahead of the sheets above. As shown in FIG. 1, the driving mechanism 30 comprises a continuous belt 32 mounted on a pair of rollers 34. However, the driving mechanism can simply be rollers with a resilient surface.

In order for the retarding element 40 to be effective in preventing other bottom sheets from being pulled out by the driving mechanism 30 along with the bottom sheet 10, the retarding element 40 must have a high friction surface 50 which is stationary relative to the moving sheet 10. The friction between the bottom sheet 10 and the sheet 10' above is lower than the friction between the retarding surface 50 and a sheet 10'. If the surface 50 of the retarding element 40 is coated with a layer of hard grit, as disclosed in Ifkovits, paper dust will accumulate at the surface section 52 at the feed zone 62 where the sheet 10' is retained by the retarding element 40 when the bottom sheet 10 is driven out and when the sheet 10' itself is subsequently driven out of the exit nip 64. After extensive use, the surface roughness is reduced mainly because of the accumulated paper dust, thereby reducing the effectiveness of the retarding surface 50. If the surface 50 of the retarding element 40 is made of an elastomeric material, as disclosed in Green and Godlewski, the contact between the sheets and the retarding surface 50 at the feed zone 62 will wear out the contact surface section 52, changing the retard characteristics of the elastomeric surface.

In order to provide an unworn portion of the retarding surface to the exit nip, Green uses a locking mechanism to keep the retarding surface stationary in operation. When it is necessary to rotate the retarding surface to provide an unworn portion at the exit nip, the operator loosens the locking mechanism and manually repositions the retarding surface. This manual method of furnishing an unworn portion of the retarding surface is sporadic and inconvenient. Furthermore, the method requires the feeder to be removed from operation in order for the operator to reposition the retarding surface.

Thus, it is desirable and advantageous and desirable to provide a simple yet effective method and device for repositioning the retarding element in order to expose a fresh retarding surface in the feed zone of a friction feeder.

SUMMARY OF INVENTION

It is an objective of the present invention to provide a simple yet effective method and device to automatically furnish an unworn portion of the retarding surface in a friction feeder while the feeder is in operation. This objective can be achieved by using a cylindrical retarding member, which is allowed to rotate freely in one direction along its rotational axis but is prevented from rotating in the other direction. The retarding member is caused to rotate against the feeding direction of the friction feeder by a pre-determined amount after or before a sheet is driven out of the exit nip.

Accordingly, the first aspect of the present invention is a retard mechanism in a feeder for releasing generally flat items from a stack, the feeder having a driving mechanism capable of moving in a driving direction for releasing one flat item at a time through an exit point, with the leading edge of said one item exiting the exit point in an exiting direction on a singulation plane, wherein the retard mechanism is positioned relative to the exit point to prevent other flat items in the stack adjacent to said one flat item from being drawn out of the exit point by a first frictional force between adjacent flat items while said one flat item is exiting the exit point, said retard mechanism comprising a frictional surface having a surface section positioned at the exit point facing the singulation plane so as to allow the frictional surface to provide a second frictional force to the other flat items for overcoming the first frictional force. The retard mechanism comprises:

a cylindrical member having a curved surface to engage with at least said surface section of the frictional surface, the cylindrical member rotabably mounted on a rotation axis for rotation such that the cylindrical member is capable of rotating in a first rotating direction for causing said surface section to move away from the exit point in a direction opposite to the exiting direction so as to allow a different surface section of the frictional surface to move into the exit point; and a motion restricting mechanism, operatively connected to the cylindrical member, for preventing the cylindrical member from rotating in a direction opposite to the first rotating direction, wherein the driving mechanism is adapted to move in a retracting direction opposite to the driving direction in an intermittent manner so as to move at least one of the other flat items in a direction opposite to the exiting direction, thereby causing the cylindrical member to intermittently rotate in the first rotating direction by the second frictional force. The driving mechanism moves in the retracting direction prior to said one flat item being released or after said one flat item has exited the exit point.

Preferably, the frictional surface is fixedly attached to the cylindrical member or is an integral part of the cylindrical member.

Preferably, the frictional surface is made of a resilient material.

Alternatively, the frictional surface comprises a layer of hard grit.

The second aspect of the present invention is a feeder for releasing generally flat items from a stack. The feeder comprises:

a driving mechanism capable of moving in a driving direction for releasing one flat item at a time through an exit point, with the leading edge of said one flat item exiting the exit point in an exiting direction on a singulation plane, and a retard mechanism, positioned relative to the exit point to prevent other flat items in the stack adjacent to said one flat item from being drawn out of the exit point by a first frictional force between adjacent flat items while said one item is exiting the exit point, wherein the retard mechanism comprises:

a frictional surface having a surface section positioned at the exit point facing the singulation plane so as to allow the frictional surface to provide a second frictional force to the other flat items for overcoming the first frictional force, a cylindrical member having a curved surface to engage with at least said surface section of the frictional surface, the cylindrical member rotably mounted on a rotation axis for rotation such that the cylindrical member is capable of rotating in a first rotating direction for causing said surface section to move away from the exit point in a direction opposite to the exiting direction so as to allow a different surface section of the frictional surface to move into the exit point; and a motion restricting device, operatively connected to the cylindrical member, for preventing the cylindrical member from rotating in a direction opposite to the first rotating direction, wherein the driving mechanism is adapted to move in a retracting direction opposite to the driving direction in an intermittent manner so as to move at least one of the other flat items in a direction opposite to the exiting direction for causing the cylindrical member to intermittently rotate in the first rotating direction by the second frictional force The generally flat items can be sheets of paper, paper documents, mailing envelopes or mailpieces.

The third aspect of the present invention is a method of improving a retarding action of a retarding mechanism in a feeder for releasing generally flat items from a stack, the feeder comprising a driving mechanism capable of moving in a driving direction in order to release one flat item at a time through an exit point, with the leading edge of said one flat item exiting the exit point in an exiting direction on a singulation plane, wherein the retard mechanism is positioned relative to the exit point to prevent other flat items in the stack adjacent to said one flat item from being drawn out of the exit point by a first frictional force between adjacent flat items while said one flat item is exiting the exit point, wherein the retard mechanism comprises:

a frictional surface having a surface section positioned at exit point facing the singulation plane to provide a second frictional force to the other flat items for overcoming the first frictional force, and a cylindrical member having a curved surface to engage with at least said surface section of the frictional surface, the cylindrical member rotably mounted on a rotation axis for rotation such that the cylindrical member is capable of rotating in a first rotating direction for causing said surface section to move away from the exit point in a direction opposite to the moving direction of said one flat item so as to allow a different surface section of the frictional surface to move into the exit point.

The method comprises the steps of:

preventing the cylindrical member from rotating in a direction opposite to the first rotating direction, and moving the driving mechanism in a retracting driving direction opposite to the first driving direction in an intermittent manner so as to move at least one of the other flat items in a direction opposite to the exiting direction, thereby causing the cylindrical member to intermittently rotate in the first rotating direction by the second frictional force.

The fourth aspect of the present invention is a retard element to be engaged with a retard mechanism in a feeder for releasing generally flat items from a stack, the feeder having a driving mechanism capable of moving in a driving direction for releasing one flat item at a time through an exit point, with the leading edge of said one item exiting the exit point in an exiting direction on a singulation plane, wherein the retard mechanism is positioned relative to the exit point to prevent other flat items in the stack adjacent to said one flat item from being drawn out of the exit point by a first frictional force between adjacent flat items while said one flat item is exiting the exit point. The retard element comprises:

a frictional surface, and a cylindrical member having a curved surface to engage with at least a surface section of the frictional surface, the surface section positioned at the exit point facing the singulation plane so as to allow the frictional surface to provide a second frictional force to the other flat items for overcoming the first frictional force, wherein the frictional surface has a plurality of cuts in a generally helical or partially helical pattern.

The present invention will become apparent upon reading the description taken in conjunction with FIG. 2*a* to FIG. 5*b*.

BEST MODE TO CARRY OUT THE INVENTION

Figure 1:
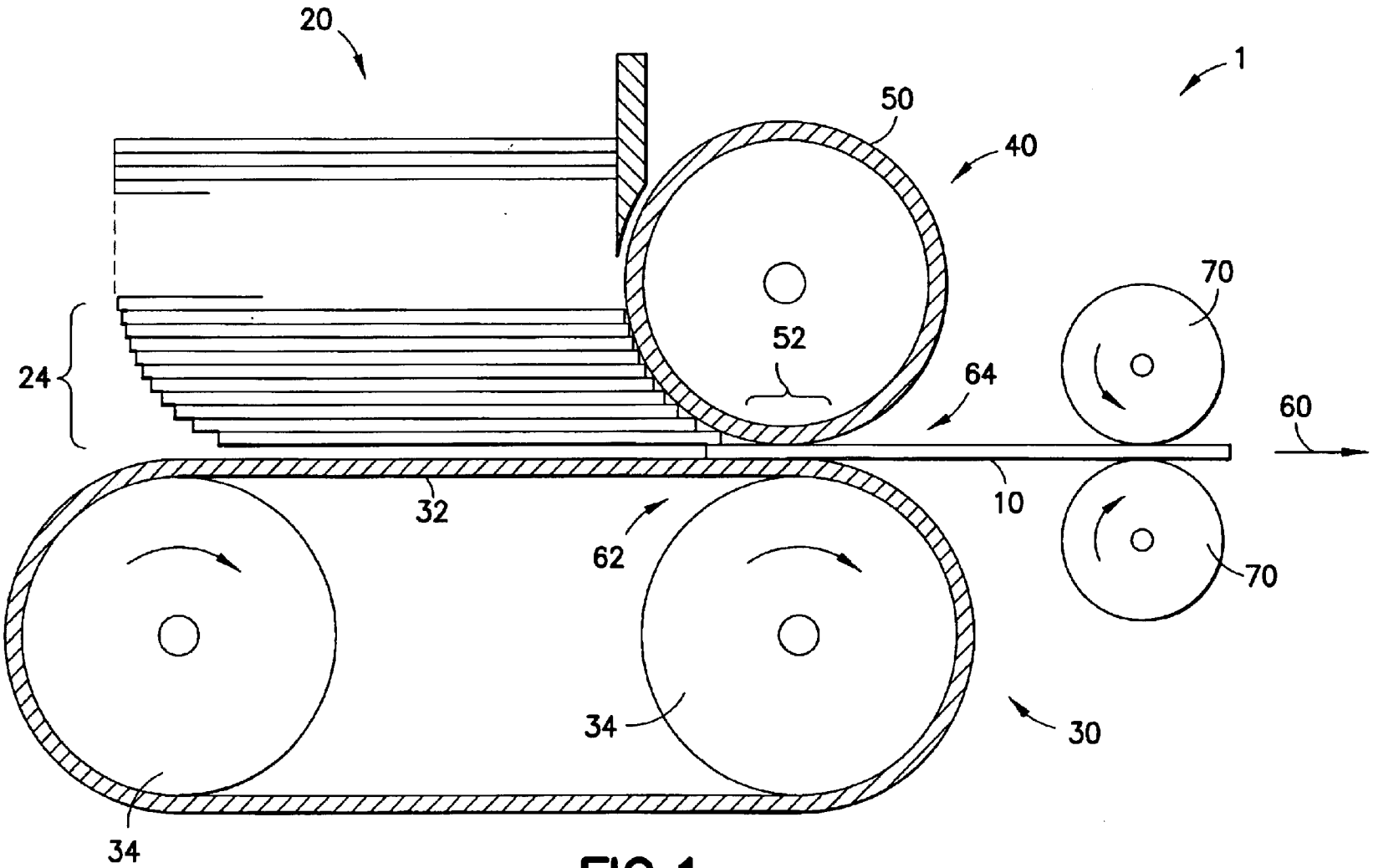
FIG. 1 PRIOR ART
FIG. 1 is a schematic representation illustrating a typical prior art friction feeder.
Figure 2A:
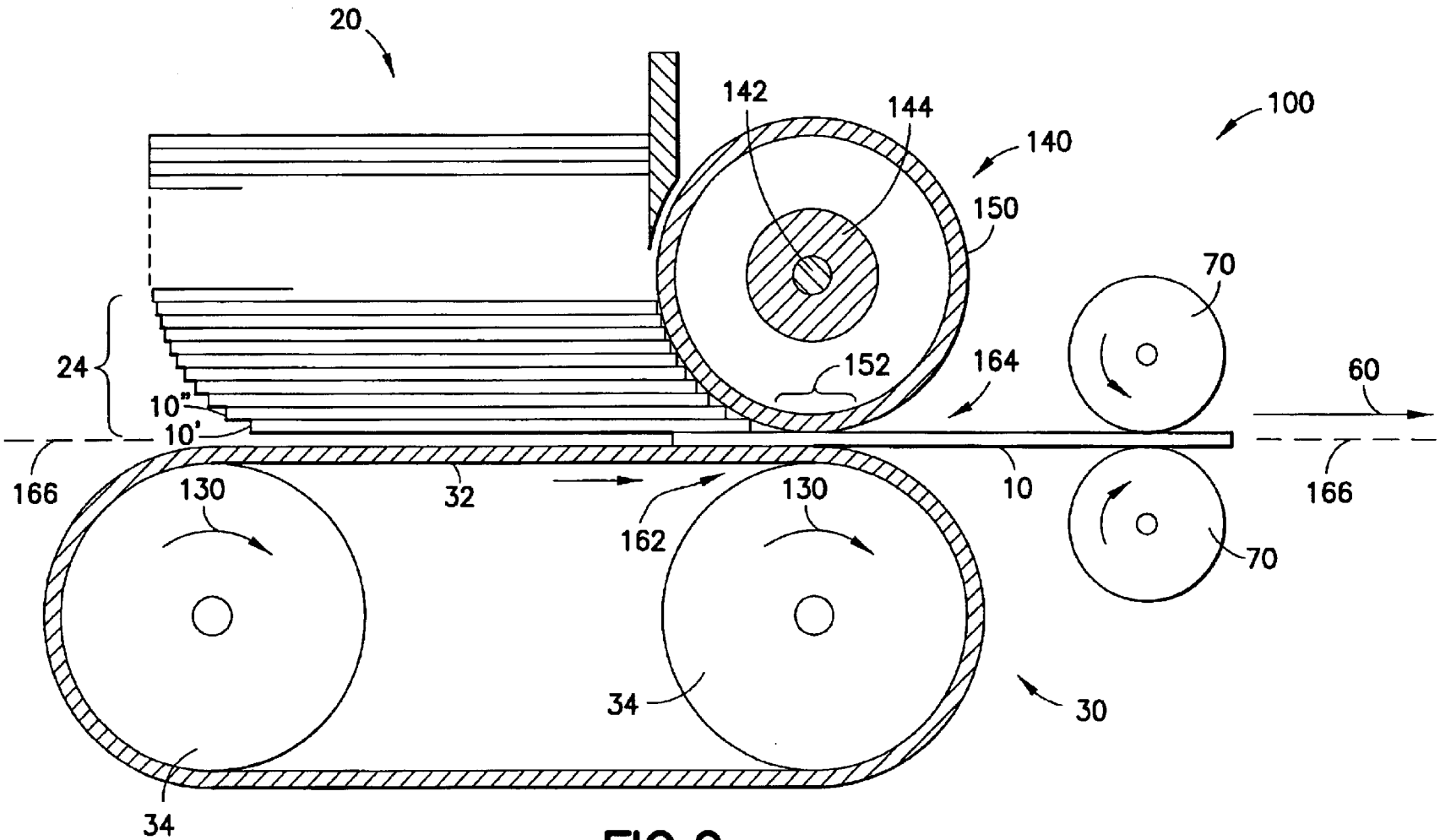
FIG. 2*a* is a schematic representation illustrating the friction feeder, according to the present invention.
Figure 2B:
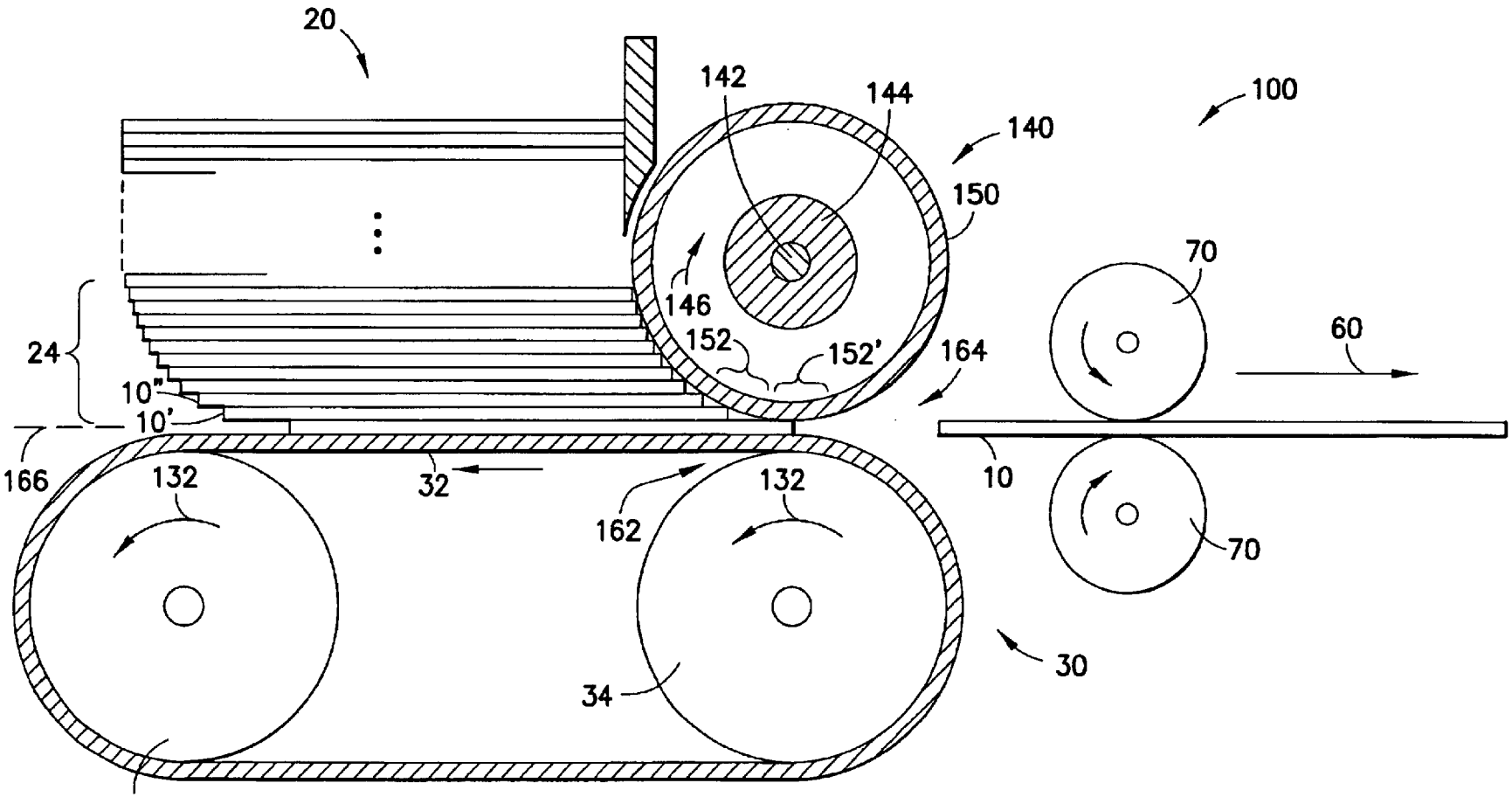
FIG. 2*b* is a schematic representation illustrating the friction feeder, wherein the retarding surface has been repositioned.

The present invention prevents the retarding surface from being worn out unevenly at one section thereof. Although the retarding surface will be eventually worn out after extensive use, the wear will be spread out over the entire circumference of the retarding surface in a simple and automatic fashion. As shown in FIG. 2*a,* the friction feeder 100, according to the present invention, comprises a generally cylindrical retarding element 140 having a retarding surface 150. The retarding surface 150 can be made of a hard material such as tungsten carbide grit, but it is preferred that it is made of a resilient material such as polyurethane or rubber. A resilient surface can be slightly deformed to allow for a reasonable gap between the retarding surface 150 and the driving mechanism 30 to form an the exit nip 164, even if the nip is set slightly fighter than normal. The retarding element 140 comprises a clutch mechanism 144 around the shaft 142 such that the retarding element 140 is locked in one direction but it is allowed to rotate freely in the opposite direction about the shaft 142. As shown in FIGS. 2*a* and 2*b,* the rollers 34 rotates in a clockwise direction 130 so as to move the sheet 10 out of the exit nip 164 on a singulation plane 166 along a moving direction 60. Thus, the retarding element 140 is allowed to rotate freely in the clockwise direction 146 such that the contacting section 152 of the retarding surface 150 at the feed zone 162 can be moved backward, against the moving direction 60.

According to the present invention, after or before a bottom sheet 10 is moved out of the stack 20, the rollers 34 are caused to move in a counter-clockwise direction 132 at a small angle so that bottom sheets in the singulated portion 24 are moved backward into the stack for a short distance. Because of the friction between the retarding surface 150 and the bottom sheets 10, the retarding element 150 is caused to rotate, moving the contact section 152 away from the exit nip 164 toward the stack 20. Thus, a new contact section 152' is moved into the feed zone 162 of the exit nip 164. As such, the retarding element 140 is caused to rotate in a clockwise direction 146 in a discrete yet regular manner, and the wear of the retarding surface 150 is spread out over the entire circumference.

Figure 3A:
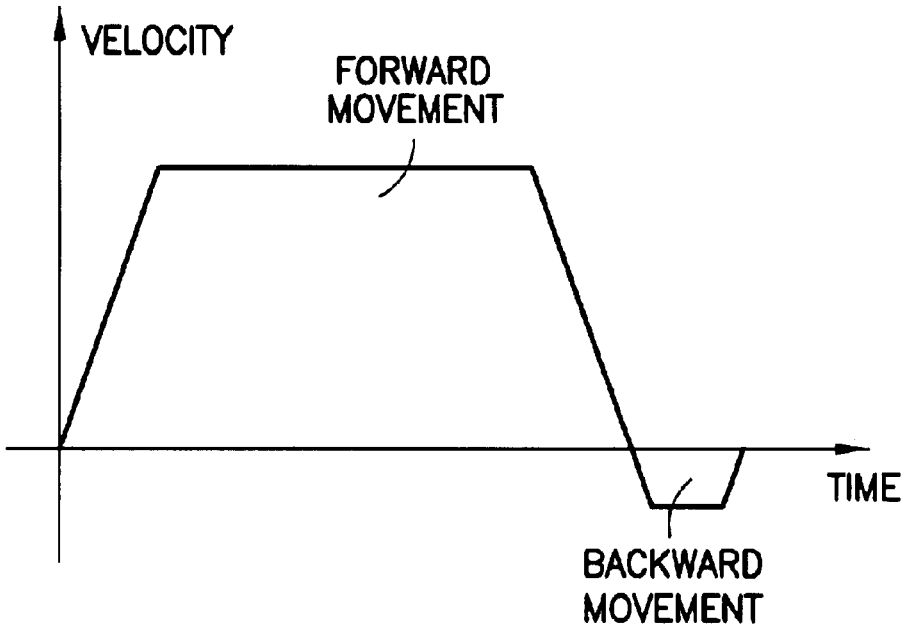
FIG. 3*a* is a schematic representation showing a velocity profile of the driving mechanism, according to the present invention.
Figure 3B:
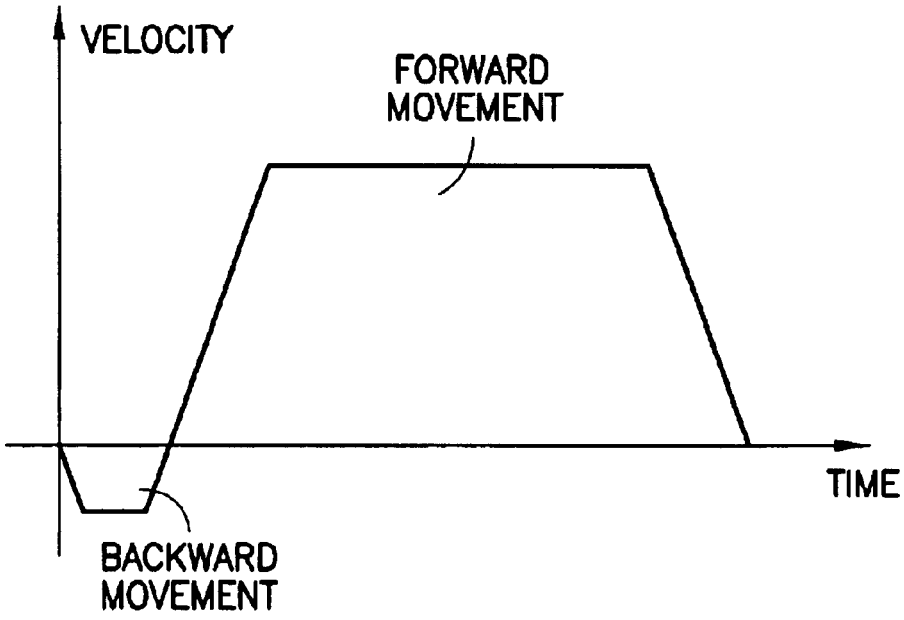
FIG. 3*b* is a schematic representation showing another velocity profile of the driving mechanism, according to the present invention.

According to the present invention, the velocity profile of the rollers 34 is represented by the plot in FIG. 3*a* or that in FIG. 3*b*. In FIG. 3*a,* the profile shows that the rollers 34 rotate backward after the bottom sheet 10 is completely driven out of the exit nip 164. Thus, it is the backward movement of the new bottom sheet 10' that causes the retarding element 140 to rotate. In FIG. 3*b,* the profile shows that the rollers 34 rotate backward before the bottom sheet 10 is driven out of the stack. Thus, it is the backward movement of the bottom sheet 10 that causes the retarding element 140 to rotate. Regardless of which velocity profile is used, the effect is the same. The reposition of the retarding surface can be carried out as part of the normal feeding operation. The backward movement of the rollers 34 is designed to be equal to only a small fraction of the forward movement.

Figure 4B:
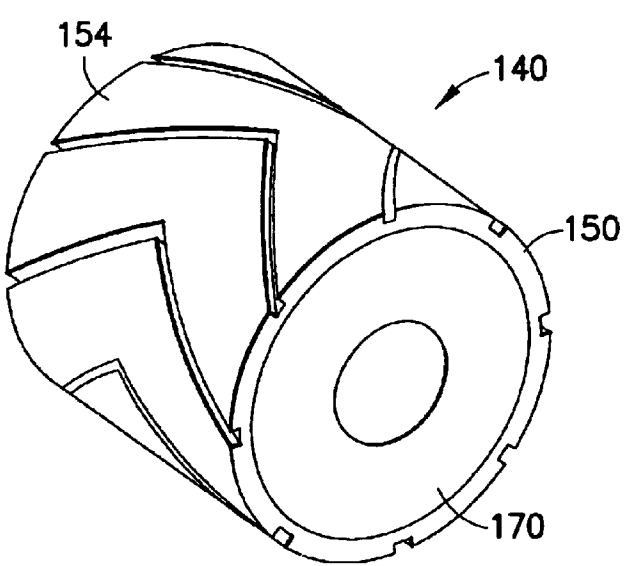
FIG. 4*b* is an isometric view of a retarding element, according to the present invention, showing another groove pattern on the surface of the retarding element.
Figure 4C:
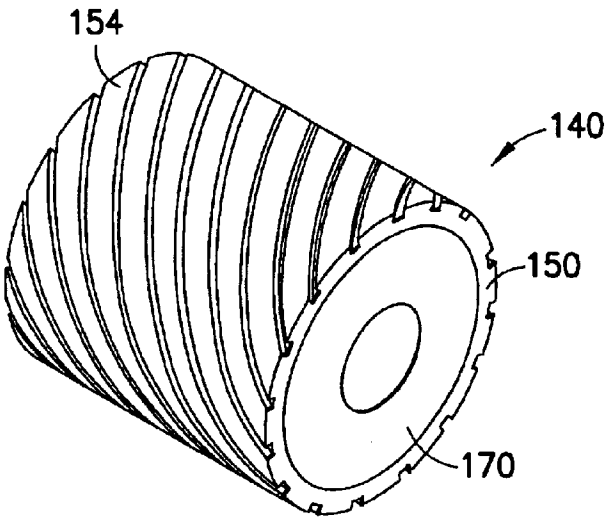
FIG. 4*c* is an isometric view of a retarding element, according to the present invention, showing yet another groove pattern on the surface of the retarding element.
Figure 4A:
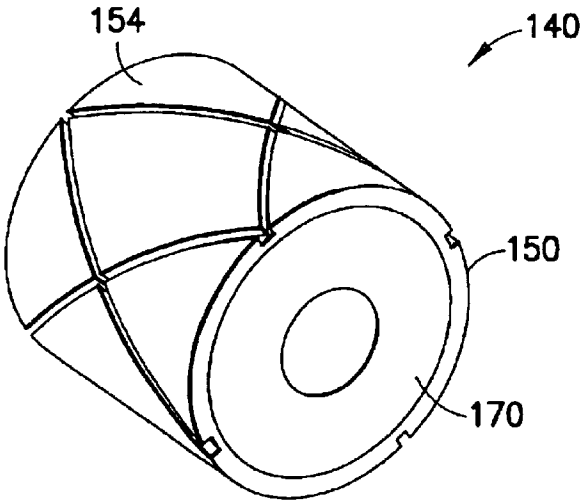
FIG. 4*a* is an isometric view of a retarding element, according to the present invention, showing a groove pattern on the surface of the retarding element.

In general, if the retarding element 140 is set correctly, then only one sheet is driven out of the exit nip at a time. When the feeder is feeding multiple sheets, the usual practice is to set the retarding element tighter, thereby reducing the gap between the retarding surface and the driving mechanism. Consequently, the pressure between the sheets and the retarding surface is also increased. If the retarding surface is made of a resilient material with high elasticity in that the friction between the retarding surface and the contacting sheets is higher than the friction within the material itself, the retarding surface becomes highly distorted under high pressure. The deformation of the retarding surface due to the upper sheets in the singulated stack portion 24 may prevent contact between the retarding surface and the lower sheets in the singulated stack portion 24. In that case, increasing the pressure does not necessarily reduce multiple feeds. It is found that providing cuts on the retarding surface 150 in a helical or partially helical pattern can reduce the undesirable deformity of the resilient surface under pressure in that the cuts interrupt the distortion profile of the retarding surface. Cuts that deviate from the tangential direction of the circumference or the direction of rotation can prevent the influence of a surface depression from reaching across a cut. Grooves cut squarely across the direction of rotation will interrupt the surface, but also will create edges that are problematic for retarding. Thus, it is preferable to provide cuts that are generally helical or partially helical. A few exemplary cut patterns are shown in FIGS. 4*a* to 4*b*. FIG. 4*a* shows a 4-helix bi-directional groove. FIG. 4*b* shows a herringbone groove pattern comprising a plurality of partial helices. FIG. 4*c* shows a 16-helix unidirectional groove.

The clutch mechanism 144 as shown in FIGS. 2*a* and 2*b* is implemented around the shaft 142 of the retarding element 140. However, the clutch mechanism 144 can be implemented on another shaft, which can be linked to the shaft 142 via gears or pulleys. So long as the retarding element 140 is allowed to rotate freely in one direction in order to reposition the retarding surface 150 and is locked in another direction to effect the retarding function, the location of the clutch mechanism 144 is unimportant. Furthermore, while it is preferable to provide cuts and grooves on the retarding surface 150, the retarding surface 150 can simply be a plain cylindrical surface of resilient material.

Figure 5A:
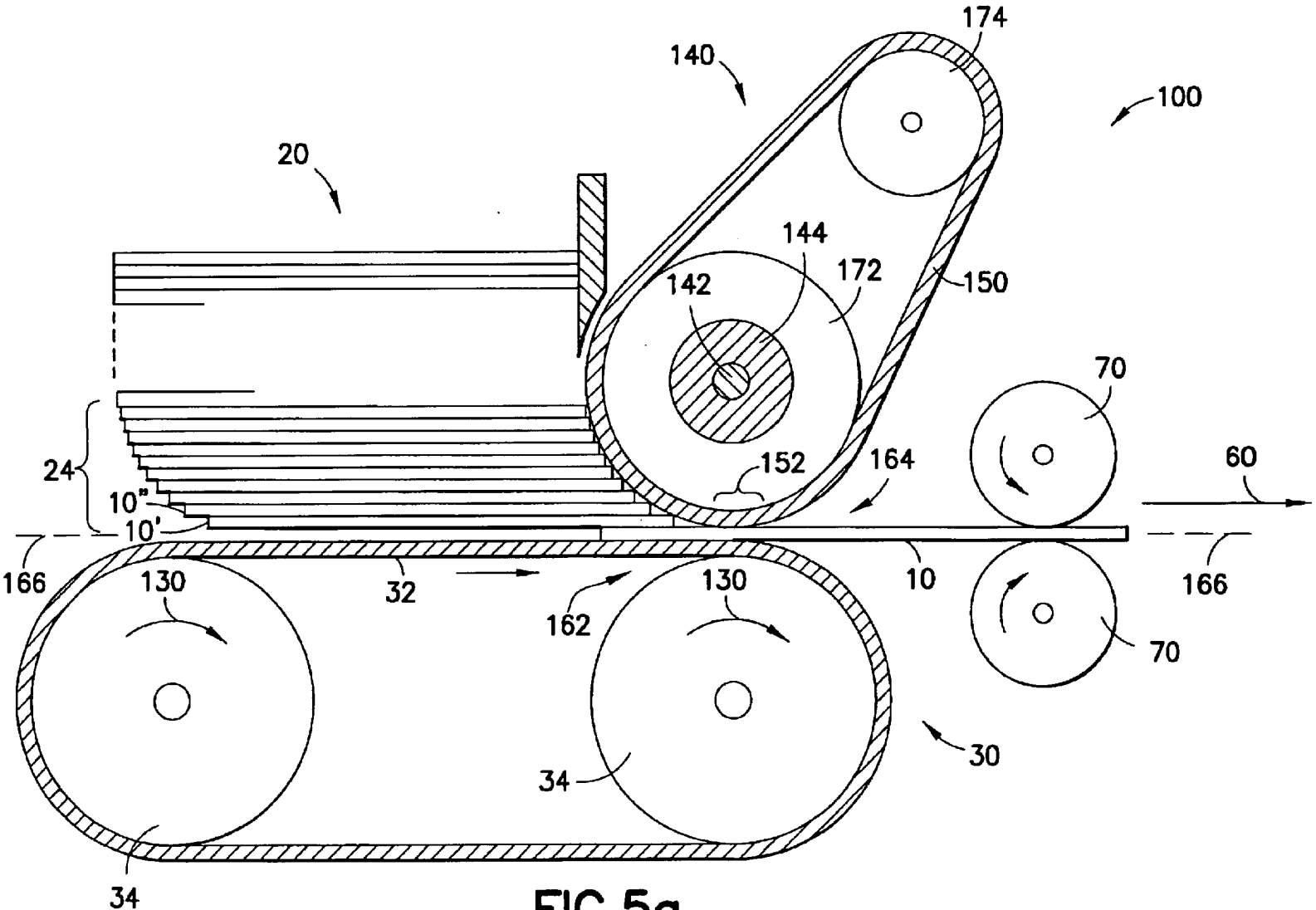
FIG. 5*a* is a schematic representation illustrating another embodiment of the friction feeder of the present invention.
Figure 5B:
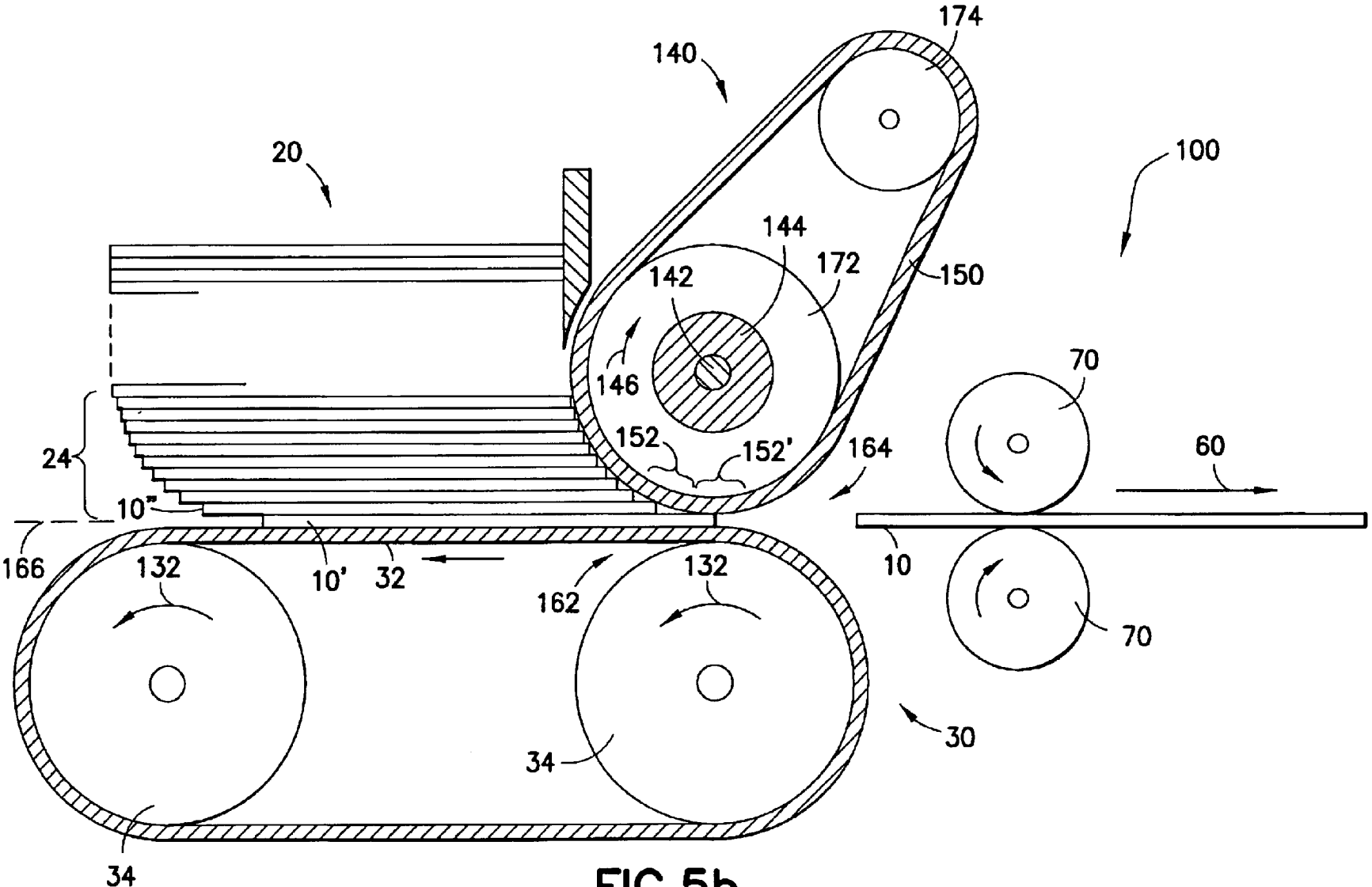
FIG. 5*b* is a schematic representation illustrating the friction feeder of FIG. 5*a,* wherein the retarding surface has been repositioned.

It should be noted that the retarding surface 150, as shown in FIGS. 2*a,* 2*b,* 4*a,* 4*b* and 4*c,* is attached to a cylinder 170 (see FIGS. 4*a*–4*c*) or is an integral part of the cylinder 170. However, the present invention is applicable to a feeder where the retarding surface 150 is not fixedly attached to a cylinder. As shown in FIGS. 5*a* and 5*b,* the retarding surface 150 is looped around the cylinder 172 and a roller 174, which is freely rotatable. Similar to the retarding element 140, as shown in FIGS. 2*a* and 2*b,* the rotation of the cylinder 172 is restricted by the clutch mechanism 144 such that the cylinder 172 can rotate freely in only one direction 146.

The feeder 100 of the present invention is generally used for releasing paper or paper documents. However, it can also be used to release generally flat items such as mailing envelopes, mailpieces or the like. The retarding element 140 is caused to rotate every time a sheet is released, as shown in FIGS. 3*a* and 3*b*. However, it is possible to rotate the retarding element 140 less frequently.

Thus, although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A retard mechanism in a feeder for releasing generally flat items from a stack, the feeder having a bi-directional driving mechanism beneath the stack and capable of driving flat items from a bottom of the stack in a driving direction for releasing one flat item at a time through an exit point, with the leading edge of said one item exiting the exit point in an exiting direction on a singulation plane, wherein the retard mechanism is positioned relative to the exit point to prevent other flat items in the stack adjacent to said one flat item from being drawn out of the exit point while said one flat item is exiting the exit point, said retard mechanism comprising:

a cylindrical member having a frictional surface with a surface section positioned at the exit point, the cylindrical member rotably mounted on a rotation axis for rotation such that the cylindrical member is capable of rotating in a first rotating direction for causing said surface section to move away from the exit point in a direction opposite to the exiting direction so as to allow a different surface section of the frictional surface to move into the exit point, and a motion restricting mechanism, operatively connected to the cylindrical member, for preventing the cylindrical member from rotating in a direction opposite to the first rotating direction, wherein the driving mechanism, in addition to moving in the driving direction, is adapted to move in a retracting direction opposite to the driving direction in an intermittent manner so as to move at least one of the other flat items in a direction opposite to the exiting direction, thereby causing the cylindrical member to intermittently rotate in the first rotating direction.

2. The retard mechanism of claim 1, wherein the driving mechanism moves in the retracting direction prior to said one flat item being released.

3. The retard mechanism of claim 1, wherein the driving mechanism moves in the retracting direction after said one flat item has exited the exit point.

4. The retard mechanism of claim 1, wherein the frictional surface has a plurality of cuts in a generally helical or partially helical pattern.

5. The retard mechanism of claim 1, wherein the frictional surface is fixedly attached to the cylindrical member.

6. The retard mechanism of claim 1, wherein the frictional surface is an integral part of the cylindrical member.

7. The retarding mechanism of claim 1, wherein the frictional surface is made of a resilient material.

8. The retarding mechanism of claim 1, wherein the frictional surface comprises a layer of hard grit.

9. A feeder for releasing generally flat items from a stack, comprising:

a bi-directional driving mechanism beneath the stack, the driving mechanism capable of driving flat items from a bottom of the stack in a driving direction for releasing one flat item at a time through an exit point, and a retard mechanism, positioned relative to the exit point to prevent other flat items in the stack adjacent to said one flat item from being drawn out of the exit point while said one item is exiting the exit point, wherein the retard mechanism comprises:

a cylindrical member having a frictional surface with a surface section positioned at the exit point, the cylindrical member rotably mounted on a rotation axis for rotation such that the cylindrical member is capable of rotating in a first rotating direction for causing said surface section to move away from the exit point in a direction opposite to the exiting direction so as to allow a different surface section of the frictional surface to move into the exit point; and a motion restricting device, operatively connected to the cylindrical member, for preventing the cylindrical member from rotating in a direction opposite to the first rotating direction, wherein the driving mechanism, in addition to moving in the driving direction, is adapted to move in a retracting direction opposite to the driving direction in an intermittent manner so as to move at least one of the other flat items in a direction opposite to the exiting direction for causing the cylindrical member to intermittently rotate in the first rotating direction.

10. The feeder of claim 9, wherein the generally flat items comprise sheets of paper.

11. The feeder of claim 9, wherein the generally flat items comprise mailing envelopes.

12. The feeder of claim 9, wherein the generally flat items comprise mailpieces.

13. A method of improving a retarding action of a retarding mechanism in a feeder for releasing generally flat items from a stack, the feeder comprising a bi-directional driving mechanism beneath the stack capable of driving flat items from a bottom of the stack in a driving direction in order to release one flat item at a time through an exit point, wherein the retard mechanism is positioned relative to the exit point to prevent other flat items in the stack adjacent to said one flat item from being drawn out of the exit point, wherein the retard mechanism comprises:

a cylindrical member having a frictional surface having a surface section positioned at the exit point, the cylindrical member rotably mounted on a rotation axis for rotation such that the cylindrical member is capable of rotating in a first rotating direction for causing said surface section to move away from the exit point in a direction opposite to the moving direction of said one flat item so as to allow a different surface section of the frictional surface to move into the exit point, said method comprising the steps of:

moving the driving mechanism in the driving direction to drive said one flat item from the exit point, preventing the cylindrical member from rotating in a direction opposite to the first rotating direction, and intermittently moving the driving mechanism in a retracting driving direction opposite to the first driving direction so as to move at least one of the other flat items in a direction opposite to the exiting direction, thereby causing the cylindrical member to intermittently rotate in the first rotating direction.

14. The method of claim 13, wherein the frictional surface is fixedly attached to the cylindrical member.

15. The method of claim 13, wherein the frictional surface is an integral part of the cylindrical member.

16. A retard element to be engaged with a retard mechanism in a feeder for releasing generally flat items from a stack, the feeder having a bi-directional driving mechanism beneath the stack capable of driving flat items from a bottom of the stack in a driving direction for releasing one flat item at a time through an exit point, wherein the retard mechanism is positioned relative to the exit point to prevent other flat items in the stack adjacent to said one flat item from being drawn out of the exit point, said retard element comprising:

a cylindrical member having a curved frictional surface with a surface section positioned at the exit point, wherein the frictional surface has a plurality of cuts in a generally helical or partially helical pattern.

17. The retard element of claim 16, wherein the frictional surface is fixedly attached to the cylindrical member.

18. The retard element of claim 16, wherein the frictional surface is an integral part of the cylindrical member.

19. The retard element of claim 16, wherein the frictional surface is made of a resilient material.

20. The retard element of claim 16, wherein the frictional surface comprises a layer of hard grit.

* * * * *